United States Patent [19]

Sayre

[11] 4,147,423

[45] Apr. 3, 1979

[54] RACK FOR PHOTOGRAPHIC FILM

[76] Inventor: S. Rex Sayre, 930 Mississippi Ave., Davenport, Iowa 52803

[21] Appl. No.: 834,738

[22] Filed: Sep. 19, 1977

[51] Int. Cl.[2] ..... G03D 13/12

[52] U.S. Cl. ..... 354/344; 354/340

[58] Field of Search ..... 354/315, 337, 338, 339, 354/340, 342, 343, 344, 345, 346, 347

[56] References Cited

U.S. PATENT DOCUMENTS

| | | | |
|---|---|---|---|
| 2,153,810 | 4/1939 | Mercer | 354/340 |
| 2,402,765 | 6/1946 | Millman | 354/344 |
| 2,447,986 | 8/1948 | Millman | 354/344 |
| 2,519,682 | 8/1950 | Magill | 354/340 |
| 2,655,849 | 10/1953 | White et al. | 354/340 |
| 2,829,575 | 4/1958 | Collins | 354/340 |
| 3,135,188 | 6/1964 | Hixon et al. | 354/346 |
| 3,316,827 | 5/1967 | Hill | 354/343 |

*Primary Examiner*—L. T. Hix
*Assistant Examiner*—Alan Mathews
*Attorney, Agent, or Firm*—Henderson, Sturm, Copican & Fix

[57] ABSTRACT

A frame assembly having a plurality of open sides to permit developing fluid to flow therethrough. A film holding assembly is formed into and extends between the ends of the frame assembly. A guide assembly is connected between the frame assembly ends across one open side of the frame assembly and in alignment with the film holding assembly. The guide assembly includes guide bars having structures detectable by touch formed thereon, each guide bar being distinguished by the number and location of said structures.

4 Claims, 3 Drawing Figures

RACK FOR PHOTOGRAPHIC FILM

BACKGROUND OF THE INVENTION

This invention relates to equipment employed for developing film. More particularly this invention relates to structures employed for holding sheet photographic film for developing.

Sheet film is widely used commercially, particularly the 4×5" (about 10.2 × 12.7 mm) size. The film is contained in a holder structure, exposed, and later removed from the holder structure for developing. The film is generally developed by dipping it into tanks containing developing chemicals. Such tanks are generally rectangular and have an open top. Racks holding the film are inserted through the open top such that the developing chemicals may reach the film. Such racks generally employ a plurality of clamping structures, each sheet of film being held by one, or clamped between two, such structures. The film must be developed in complete darkness, and current rack structures are not easily operable in such conditions.

Some racks have been developed which are employed to develop film in conditions of other than complete darkness. The structures necessary to shield the film from light while being developed result in the rack being more complex and expensive to manufacture.

Certain equipment has been developed which employs a tank rotatable about a horizontal axis. These tanks are commonly employed to develop 35mm, 120mm and roll film such as is used by the ubiquitous "instamatic" type cameras. The tank has a reciprocating rolling motion to insure even pick-up of developing fluid. Such automatic methods have not been employed for developing sheet film, a suitable rack for the film not yet having been devised.

SUMMARY OF THE INVENTION

A frame assembly includes opposed end members connected by open side members. A film holding assembly includes a plurality of grooves formed into the facing surfaces of the end members and a plurality of retainer rods extending between the end members. A guide assembly includes a plurality of guide bars extending between the end members, and across an open-side member, of the frame assembly. The guide bars each have members detectable by touch disposed thereon in distinctive numbers and locations. The guide bars are arranged with respect to the elements of the film holding assembly such that sheets of film may be readily guided therebetween each into a separate set of grooves even in complete darkness. The frame assembly fits securely within a standard rotating tank for developing roll film.

It is an object of this invention to provide a rack for holding photographic sheet film for developing which rack is quite easily operated in total darkness.

It is another object of this invention to provide a rack for holding photographic sheet film that enables such film to be developed in structures having rotating developing tanks normally employed to develop roll film.

Still another object of this invention is to provide a rack for holding photographic sheet film that enables at least part of the developing process to be mechanized.

A further object of this invention is to provide a rack for holding photographic sheet film which is relatively simple in construction and operation, yet sturdy and capable of achieving the objects aforementioned.

These objects and other features and advantages of this invention of a rack for holding photographic film will become readily apparent upon referring to the following description, when taken in conjunction with the appended drawing.

BRIEF DESCRIPTION OF THE DRAWING

This invention of a rack for holding photographic film is illustrated in the drawing wherein.

DESCRIPTION OF THE PREFERRED EMBODIMENT

Figure 1:
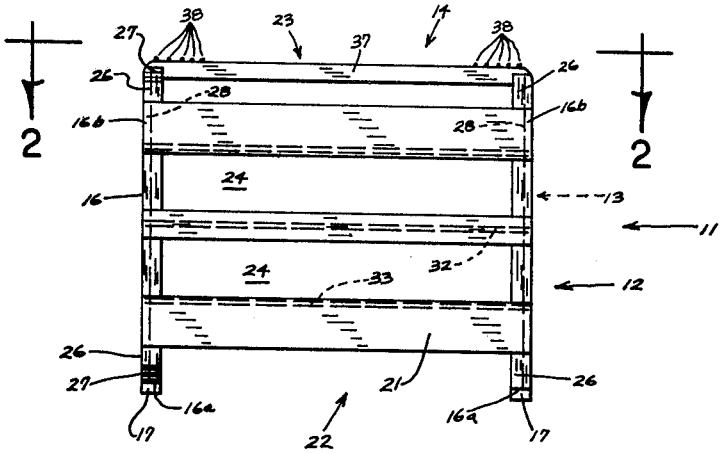
FIG. 1 is a side elevational view of the rack.

Referring now to the drawing, the invention of a rack for holding photographic film is illustrated generally at 11 in FIG. 1. The rack 11 more particularly includes frame, film holding and guide assemblies 12, 13, 14 indicated clearly in FIG. 3.

Figure 3:
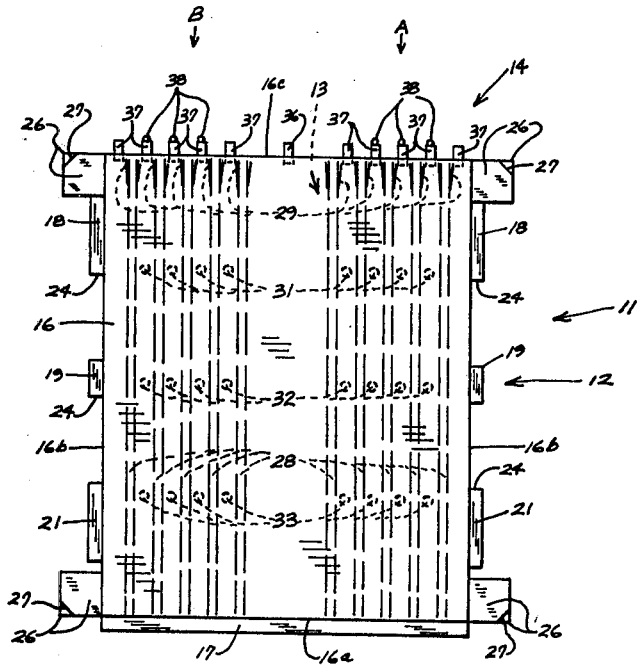
FIG. 3 is an end elevational view of the rack taken along line 3—3 of FIG. 2.

Referring to FIGS. 1 and 3, the frame assembly 12 includes a pair of parallel, rectangular end plates 16. A base bar 17 is affixed to the bottom edge **16*a* of each end plate 16. The end plates 16 are connected by pairs of upper, middle and lower side plates 18, 19, 21 extending between side edges 16*b*. The middle side plates 19 have a smaller transverse dimension than the upper and lower side plates 18, 21. An open bottom side 22 is defined between the base bars 17. An open top side 23 is defined between the upper edges 16*c* of the end plates 16. Spaces 24 defined by the side plates 18, 19, 21 result in the frame assembly 12 having sides which are substantially open. Four resilient supports 26 are affixed to each end plate 16, each support 26 being attached to a side edge 16*b* and adjacent either the top or bottom edges 16*a,c* of the plate 16. The supports 26 are generally rectangular in conformation but may have beveled edges as shown at 27**.

Figure 2:
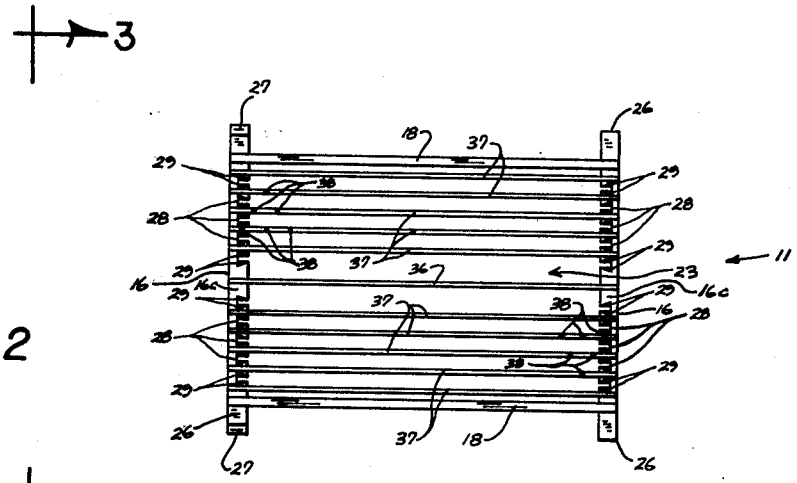
FIG. 2 is a top plan view of the rack taken along line 2—2 of FIG. 1.

The film holding assembly 13 includes a plurality of grooves 28 (FIGS. 2 and 3). The grooves 28 are formed into the sides of the end plates 16 which are facing. The grooves 28 extend between the bottom and top edges 16 *a,c* of the plates 16. The grooves 28 have widened upper ends 29 extending through the top edges **16*c*. The grooves 28 of each plate 16 are grouped on opposite sides of a plane bisecting the plate 16 and bottom and top edges 16** *a,c* thereof (FIG. 3). Each groove 28 of one end plate 16 is aligned with a facing groove 28 of the other end plate 16 such that the aligned grooves 28 define a plurality of parallel planes (FIG. 2).

The film holding assembly 13 includes pluralities of parallel upper, middle and lower retainer rods 31, 32, 33. The rods 31, 32, 33 are affixed normal to, and extend between, the end plates 16 (FIG. 1). Referring to FIG. 3, the upper retainer rods 31 define a plane normal to side edges **16*b* and cutting through the upper side plates 18. The middle and lower retainer rods 32, 33 define similar planes which pass through the middle and lower side plates 19, 21 respectively. The retainer rods 31, 32, 33 also are grouped on opposite sides of the plane bisecting the plates 16 and bottom and top edges 16** *a,c* thereof. Each rod 31, 32 or 33 is attached to each end plate 16 between two adjacent grooves 28 formed into the plate 16; however, no rods 31, 32, 33 are disposed between those grooves 28 closest to the plane bisecting plates 16 and edges 16 *a,c*.

The guide assembly 14 includes a central longitudinal bar 36 (FIGS. 2 and 3) which spans the open top 23 and is attached to the top edges 16c of the end plates 16. The bar 36 is within the plane bisecting the end plates 16 and edges 16 *a,c*. The guide assembly 14 also includes a plurality of side longitudinal bars 37. The bars 37 are attached to the top edges 16c and are parallel to, and grouped on each side of, the central bar 36. Each bar 37 is disposed between either two adjacent pairs of aligned grooves 28 or an outside pair of aligned grooves 28 and the upper side plates 18 (FIG. 2). Each bar 37 except the outside bars 37 adjacent the plates 18, together with an upper retainer rod 31, a middle retainer rod 32 and a lower retainer rod 33, defines a plane normal to the edges 16 *a,c* (FIG. 3).

As shown particularly in FIG. 2, the guide assembly 14 further includes a plurality of knobs or projections 38. The projections 38 are attached to certain of the side longitudinal bars 37 and extend therefrom away from the open top 23. The rack 11 shown in FIG. 2 employs two groups A, B of five side bars 37 each. The bars 37 of each group A, B which are closest to, and remotest from, the central bar 36 have no projections 38. The remaining three bars 37 of each group A, B, from the bar 37 next closest to, to the bar 37 next farthest from, bar 36, have three, two and one projection(s) 38 respectively. The projections 38 are disposed at one end of the bars 37 of group A but on the opposite end of the bars 37 of group B.

The rack 11 can be constructed of a hard commercial plastic such as an acrylic and, where necessary the various parts joined by a suitable adhesive. The retainer rods 31, 32, 33 are made of stainless steel. The projections 38 are to be preferred, but notches (not shown) may be substituted therefor.

The rack 11 is employed in the generally complete darkness of a room employed for developing film. Commonly, sheet film has a notch formed into a transverse edge thereof adjacent a longitudinal edge thereof; and the photographer then can by touch ascertain the emulsion side of the sheet film. The photographer grasps the film and employs the guide assembly 14 to properly insert the film into film holding assembly 13.

The photographer uses the guide assembly 14 by running his finger along the lengths of the bars 36, 37 and detecting the placement of the projections 38. The photographer can ascertain to which side of the bar 36 a bar 37 is disposed by the location of the projections 38. How far the bar 37 is from the bar 36 is communicated by the number of projections. The central plane is marked by the bar 36.

Having located a bar 37 and ascertained its placement with respect to the center plane defined by bar 36, the photographer guides the film toward the rack 11 adjacent the bar 37 to the side thereof facing the center bar 36. The film in this manner is guided into an aligned pair of grooves 28. The widened upper ends 29 aid the insertion of the film into the grooves 28, and the film is slidably received within the grooves 28. The film is loaded into the rack 11 such that the emulsion side of the film faces the central bar 36.

After the sheet film has been loaded into the grooves 28, the rack 11 is inserted into a rotating developing tank (not shown). The eight resilient members 26 support the rack 11 within the tank, the members 26 having right angular or beveled edges as required by the interior wall structure of the developing tank. The tank is partially filled with developing chemicals and, when actuated, rotates about its longitudinal, substantially horizontal axis first in one direction, then back to level, and then in the opposite direction and so forth in a reciprocating manner. While the rack 11 is slidable within the tank such that the rack 11 may be inserted and removed, the rack 11 fits tightly enough within the tank such that it rotates with the tank in a reciprocating fashion, thereby causing the sheet film to be carried through the developing chemicals. The retainer rods 31, 32, 33 and also the side plates 18, 19, 21 provide support for the sheet film during movement through the developing fluid, aiding in keeping the film within the grooves 28 and in keeping the film somewhat flat to facilitate even pick-up of developing fluid.

Typically, black and white film requires about fifteen minutes at about 70° F., and color film something over three minutes at about 100° F., for developing. The rack 11 can be constructed readily of dimensions to accommodate 4 × 5" (about 10.2 × 12.7 mm) sheet film, the most common size employed by commercial photographers, or to accommodate 2¼ × 3¼" (about 5.7 × 7.3 mm) film, a size commonly employed by amateur photographers, within the grooves 28. The rack 11 therefore can be employed by a wide variety of photographers. Also, it can be seen that the guide assembly 14 renders the rack 11 readily operable in conditions of complete darkness. The conformation of the grooves 28 also facilitate this result. The frame assembly 12 and retainer rods 31, 32, 33 readily adapt the rack 11 to use with a rotating developing tank, thereby rendering such tanks employable for sheet film. The developing of sheet film is to some extent mechanized thereby.

Although a preferred embodiment of the rack for photographic sheet film and modifications thereof have been disclosed herein, it is to be remembered that various modifications and alternate constructions can be made thereto without departing from the full scope of the invention, as defined in the appended claims.

I claim:

1. A rack for photographic sheet film, said rack comprising:

frame means having end plates and side members, said end plates being connected by said side members, each end plates defining an open top side, said side members being spaced apart to provide substantially open sides;

means for holding sheet film including a plurality of grooves formed into said end plates, each groove in one of said end plates facing toward, and being in alignment with, one of said grooves in the other of said end plates to form an aligned groove pair; and guide means spanning said open top side, said guide means including a plurality of guide bars attached to and extending between said end plates, each guide bar being placed adjacent to one of said aligned groove pairs, said guide means including a plurality of projections, said projections being attached to said guide bars, each guide bar having a different number of projections attached thereto.

2. A rack for photographic film as defined in claim 1 and further wherein said guide bars and aligned groove pairs are formed into two groupings, said groupings being disposed on opposite sides of a central plane bisecting said end plates and passing intermediate said open sides formed by said side members, said projections attached to said guide bars of one of said groupings being adjacent one of said end plates, said projections attached to said guide bars of the other of said groupings being adjacent the other of said end plates.

3. A rack for photographic film, said rack comprising:

frame means having end plates and side members, said end plates being connected by said side members, said end plates defining an open top side, said side members being spaced apart to provide substantially open sides and including upper, middle and lower side members defining each open side;

means for holding sheet film including a plurality of grooves formed into said end plates, each groove in one of said end plates facing toward, and being in alignment with, one of said grooves in the other of said end plates to form an aligned groove pair, said means for holding sheet film including a plurality of retainer rods extending between said end plates each retainer rod being disposed adjacent one of said aligned groove pairs, said retainer rods being arranged into three rows, each of said rows being aligned with either said upper side members, said middle side members or said lower side members; and guide means spanning said open top side, said guide means including a plurality of guide bars attached to and extending between said end plates, each guide bar being placed adjacent to one of said aligned groove pairs.

4. A rack for photographic sheet film as defined in claim 2 and further wherein said guide means includes a central bar attached between said end plates and defining said central plane.

* * * * *